United States Patent [19]

Zernow

[11] 3,976,010

[45] Aug. 24, 1976

[54] SPIN COMPENSATED LINER FOR SHAPED CHARGE AMMUNITION AND METHOD OF MAKING SAME

[75] Inventor: Louis Zernow, Glendora, Calif.

[73] Assignee: Whittaker Corporation, Los Angeles, Calif.

[22] Filed: Apr. 16, 1973

[21] Appl. No.: 351,292

[52] U.S. Cl. ..... 102/56 SC; 102/24 HC; 29/521

[51] Int. Cl.[2] ..... F42B 13/10; F42B 1/02

[58] Field of Search ..... 29/521; 102/24 HC, 56 SC

[56] References Cited

UNITED STATES PATENTS

| | | | |
|---|---|---|---|
| 3,025,794 | 3/1962 | Lebourg et al. | 102/24 HC |
| 3,146,711 | 9/1964 | Schaadt et al. | 102/24 HC |
| 3,217,650 | 11/1965 | Paul et al. | 102/56 |
| 3,218,975 | 11/1965 | Massey | 102/56 |
| 3,726,224 | 4/1973 | Pugh et al. | 102/56 |

*Primary Examiner*—Verlin R. Pendegrass
*Attorney, Agent, or Firm*—Jay H. Quartz; Donald E. Nist

[57] ABSTRACT

A shaped charge liner is made by forming a pair of hollow conical sub-liners, without any uncontrolled residual tangential shear stress (e.g. by a deep drawing method) so that they mate together to form a single conical liner. One sub-liner is inserted in the other and then one pair of subliner ends are locked together. Thereafter, the sub-liners are counter-rotated about their attachment point and locked together at their other pair of ends to retain the counter-rotation. This counter rotation generates opposite residual tangential shear stresses in the two sub-liners which may or may not be equal to each other.

9 Claims, 3 Drawing Figures

FIG. 1.
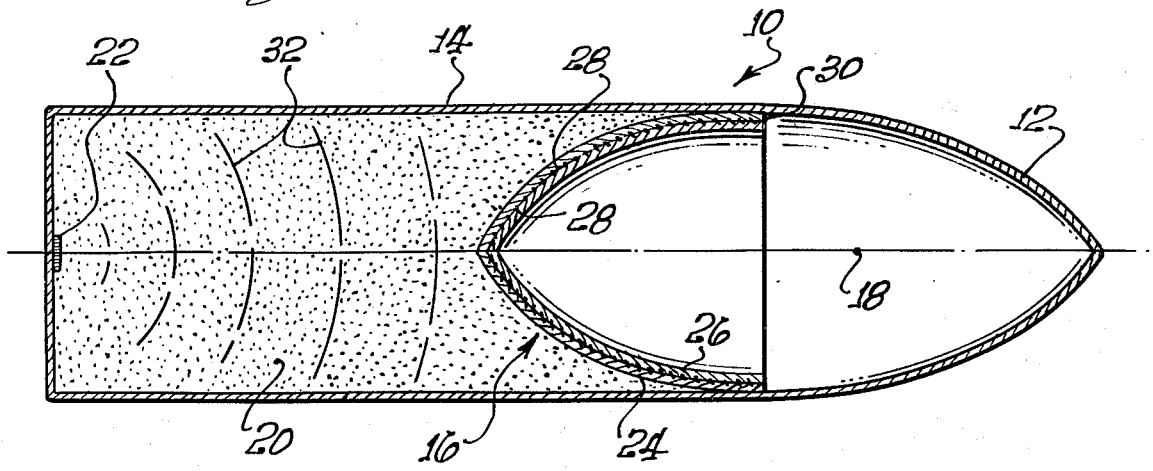
FIG. 2.
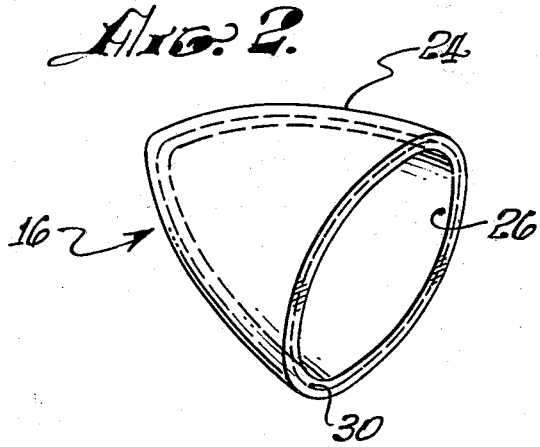
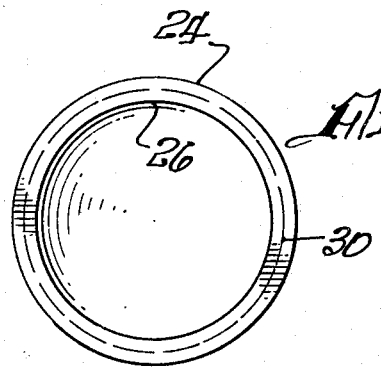
FIG. 3.

SPIN COMPENSATED LINER FOR SHAPED CHARGE AMMUNITION AND METHOD OF MAKING SAME

BACKGROUND OF THE INVENTION

This invention relates to ammunition and, more particularly, to shaped charge ammunition which is fired at a target with a spin.

Shaped charge ammunition, broadly, may include projectiles which are merely dropped, e.g., bombs, as well as projectiles which are fired from a rifled barrel, e.g., shells. In general, no spin is imparted to the former group of projectiles whereas the second group of projectiles spin as they approach their target. This invention applies to the latter "spinning" projectiles.

In brief, shaped charge ammunition comprises an aerodynamic nose section and a cylindrical rear section. The latter contains a hollow conical liner which is symmetrically positioned about the cylinder axis at the forward end of the cylindrical section with its open end opening forward. It also contains an explosive charge which is carried behind and in contact with the liner. When a detonator in contact with the rear face of the explosive charge is detonated, a detonation wave moves rapidly through the explosive charge to cause the formation of a shaped charge jet which is formed from the inner portion of the metal liner. The jet is a high velocity stream of metal which is projected forward along the axis of the cone. In the absence of spin compensation, the spin imparted to shaped charge ammunition prevents the jet from forming into an axially-aligned stream with maximum penetrating ability. Instead, portions of the jet exit from the shaped charge ammunition as a cluster of discrete metal streams of greatly reduced penetrating power. This results in a plurality of relatively shallow holes in the target rather than a single deep hole. When the target is armor, e.g., tank armor, inability of the jet to form into a single stream generally means that the armor will not be penetrated and that the shaped charge ammunition has failed to perform its intended mission.

This inventor has recently proven experimentally that properly oriented residual tangential shear stresses in shaped charge liners ("cones") explain why certain shear formed or rotary extruded liners will compensate for the spin given to shaped charge ammunition, thereby permitting the formation of a single, highly penetrating metal jet stream from the shaped charge cones. For almost twenty years, it has been known that shear-formed or rotary-extruded cones exhibited spin compensation characteristics. However, it was not known what physical mechanism(s) was responsible for this. Prior to the aforementioned experimental work by this inventor, there were conflicting publications regarding the effect of residual shear stresses in compensating for shaped charge liner spin (G. F. Carrier and W. Prager, *Influence of Residual Stresses on Liner Performance*, Technical Report No. 1, DA-3426/1, Brown University (1954); C. M. Glass et al., *Effects of Anisotropies in Rotary Extruded Liners*, BRL Report No. 1084 (1959)).

The effect of this lack of understanding of spin compensation mechanisms was that it was difficult to perform meaningful quality control on the manufacture of the liner and on the control of the degree of spin compensation. The reason for this is that it was not clear what measurements should be made on the manufactured liner to evaluate its expected spin compensation performance, since the physical mechanism responsible for the spin compensation performance had not been identified.

Identification of the residual tangential shear stress mechanism has now provided a logical measurement basis, as well as the new basis for the manufacture of spin compensating cones described herein.

SUMMARY OF THE INVENTION

This invention includes shaped charge liners and the method for fabricating such liners so that each liner will exhibit spin compensation characteristics. Furthermore, the liners of this invention can exhibit spin compensation characteristics in varying degrees as dictated by each application so that the spin compensation can be tailored to each application.

More specifically, this invention includes forming a shaped charge liner comprising a pair of hollow, conical sub-liners sized to fit in coaxial abutting relation one within the other. The sub-liners, after being fitted together in mating relation, are locked together at or near one pair of their ends. Subsequently, they are oppositely twisted and locked together at their other ends to thereby lock in the resulting counter-rotation so that a residual shear stress is produced in the liner itself. The amount of spin compensation is determined by the residual tangential shear stresses generated by relative rotation of the subliners which may be formed in well-known ways.

DESCRIPTION OF THE DRAWINGS

FIG. 1 is a cross-sectional view, taken along its length, of a shaped charge projectile including a liner of this invention.

FIG. 2 is a perspective view of the liner of this invention.

FIG. 3 is a bottom plan view of the liner of FIG. 2.

DESCRIPTION OF THE PREFERRED EMBODIMENT

The shaped charge liner of this invention comprises a pair of mating sub-liners which are oppositely twisted. The sub-liners are joined together adjacent their apices and adjacent their bottoms to lock-in the aforementioned opposite twist to thereby leave the liner with a residual shear stress.

Referring now to the Figures and, initially, to FIG. 1, the numeral 10 designates a shaped charge projectile which basically comprises a hollow, aerodynamic nose section 12 and a trailing or rear cylindrical section 14. The latter section 14 encloses a hollow, conical, shaped charge liner 16 which opens forwardly and which is axially aligned with respect to the longitudinal axis 18 of the shaped charge projectile 10. The remainder of the volume generally rearward of the liner 16 is filled with an explosive 20 which may be detonated by a detonator 22 located on the projectile axis 18. The latter, in turn, may be detonated by an electrical signal transmitted from the leading portion of the nose section 12 upon contact with a target as is well known. Both the detonator 22 and explosive 20 are old in the art and neither forms a part of this invention.

Referring now to FIG. 2, the liner 16 comprises a pair of sub-liners 24,26 which abut together in mating relation over their respective facing inner and outer surfaces. The sub-liners 24,26 are preferably made of a ductile face centered cubic metal such as copper as is well known in the art. Each sub-liner 24,26 may be made by deep drawing or even by shear forming or rotary extrusion techniques. If this latter procedure is used for fabrication, two possible techniques exist. In the first, substantially all of the residual shear stresses are annealed out of the rotary extruded sub-liners 24,26 prior to their use in the coaxial assembly so that substantially the only tangential residual shear stress in the liner 16 is that which is placed there by the hereafter-described counter-twisting or rotation of the sub-liners. Annealing of the sub-liners 24,26 may take place during the sub-liner forming operation by conducting the latter operation at elevated temperatures or by appropriately heating the shear formed sub-liners after they are formed.

An alternate method for using shear-formed (rotary extruded) sub-liners 24,26 which does not require annealing of their residual stresses prior to their use in the coaxial assembly 16, involves shear forming the individual sub-liners in opposite directions so that each sub-liner would have intrinsic spin compensation properties of opposite direction. In this case, shear-formed sub-liners 24 and 26 can be used in assembling the coaxial system 16, without annealing, so long as opposite compensation characteristics are used in the two sub-liners.

Further enhancement of the residual tangential shear stresses can be obtained by: (a) shear-forming the individual sub-liners at reduced temperature, e.g., under cryogenic cooling of the metal as well as the forming tools (with liquid nitrogen or carbon dioxide); (b) reducing the heating rate during the deformation process by using slower forming speeds, with or without auxiliary cooling; or (c) using alternative metals or alloys capable of retaining higher tangential shear stresses, thereby generating higher spin compensation capabilities.

It will be understood that a liner having a high residual shear stress and not comprising sub-liners as described herein could be produced by the foregoing techniques. However, it is presently believed that the herein-described double-walled liner provides better control of the residual tangential shear stress and, therefore, the spin compensation.

The shape of the liner 10 and sub-liners 24,26 is generally conical. As used herein and in the claims, the term "conical" means generally conical and includes, e.g., trumpet shapes.

After formation of the sub-liners 24,26, the smaller or inner sub-liner 26 is positioned within the larger sub-liner 24 and the two sub-liners are locked together at or adjacent one of their ends, e.g., their respective apices (shown in FIG. 1 by the cross-hatching 28 of the boundary line between the two sub-liners). Thereafter, the sub-liners 24,26 are twisted, in a suitable apparatus, in opposite directions about their apices. The amount of twisting may be predetermined by calculating the amount of residual shear stress which must be retained in the liner 16 to provide the desired spin compensation. At a maximum, each sub-liner 24 or 26 may be twisted to the limit of its tangential shear yield strength. After the desired counter-rotation of the sub-liners 24,26 has been obtained, the sub-liners are locked together in their twisted orientation at or adjacent to their other ends (in this case at their open ends as shown in FIG. 1 by the numeral 30).

Instead of locking one pair of ends, twisting the sub-liners 24,26 with a single twisting operation, and then locking the other pair of ends, the sub-liners may be sequentially twisted and locked in annular volume increments progressively from one pair of ends to the other to maximize the residual shear stress by taking advantage of the fact that the maximum shear stress which may be induced at any point in the sub-liners 24,26 is a function of the cross-sectional area at that point in the sub-liners (zero at the apices). More specifically, the sub-liners 24,26 may first be locked together at one of their ends, for example, at their apex ends. Then the sub-liners 24,26 may be twisted to induce in an incremental section adjacent the locked ends a shear stress which is a maximum for that section. The shear stress induced in the incremental section is then locked therein. Again the sub-liners 24,26 are counter-rotated to produce a maximum shear stress in a second incremental section adjacent to the first incremental section and this residual shear stress is then locked in this section. These steps are repeated progressively along the length of the sub-liners 24,26 to the other pair of ends which are then interlocked.

The sub-liners 24,26 may be interlocked by any one of several methods with the locking method used at one pair of ends being the same as or differing from the locking method used at the other pair of ends. For example, adjacent sub-liner ends may be interlocked: by mechanically pinning them together; by roughening facing mating surfaces to provide an interference fit; or by welding. If welding or any other heat-producing locking method is used, care must be taken to control the sub-liner temperature to prevent annealing of the shear stresses. When employing the aforedescribed sequential twisting and locking method, it is advantageous to roughen the confronting mating surfaces of the sub-liners 24,26 and to size the sub-liners so that a slip fit is effected between them. As each incremental section is stressed, the size of the sub-liners may be concurrently altered to produce an interference fit at that section to lock the two sub-liners 24,26 together at that section. This may be done by expanding the inner sub-liner 26, by compressing the outer sub-liner 24, or both.

The sub-liners 24,26 may be twisted by using techniques which are known in the art. For example, conical mandrels with roughened surfaces may be inserted into the smaller sub-liner 26 and slipped over the larger sub-liner 24 to provide the desired counter rotation.

In operation, the projectile 10 impacts a target (not shown) causing a signal to be transmitted to the detonator 22 to detonate it. In turn, the detonator 22 detonates the explosive 20 so that detonation waves 32 which are centered on the projectile axis 18 travel rapidly toward the liner 16. The leading detonation wave 32 contacts the apex of the larger sub-liner 24 to cause collapse of all of the liner metal with the inner portion of the small sub-liner 26 forming the jet. The jet material travels forward along the axis 18 and consists of material from the apex region of the inner sub-liner 26 followed by material from the side walls of the inner sub-liner 26 as the detonation waves 32 progress forwardly along the sides of the liner 16. The liner material forms an elongated jet of material (not shown) along the projectile axis 18. Even though the projectile 10 is spinning, the residual tangential shear stress distribution in the sub-liners 24 and 26 causes the jet material to spin in a direction opposite that of the projectile, and thus to align itself with the projectile axis 18 to form a single jet. By comparison, in the absence of liner residual tangential shear stress, much of the jet material would be projected forwardly out of alignment with the projectile axis 18 so that more than one jet of reduced penetration power would be formed.

The residual tangential shear stresses in each of the sub-liners 24,26 have to be in opposite directions to each other, but they do not have to be equal to each other to obtain the desired spin compensation. In fact, they can be equal or unequal to each other and still provide spin compensation since it is essentially the inner sub-liner 26 which provides the jet with counter-rotation to compensate for the spin given to the jet by the rotation of the shell, etc. Of course, the outer sub-liner 24 serves to lock the residual tangential shear forces in the inner sub-liner 26 in position and turns oppositely to the latter during the spin compensation event. Once it is known which direction of spin will be imparted to a projectile by rifling, the direction of twist given to the inner sub-liner 26 will be that which will impart an opposite rotation, i.e., which will spin compensate, and the direction of twist given to the outer sub-liner 24 will be opposite to that of the inner sub-liner 26.

I claim:

1. A method of forming a spin compensating, shaped-charge liner, comprising the steps of:

forming a pair of hollow, conical sub-liners sized to coaxially mate together;

inserting one said sub-liner within the other said sub-liner to form a hollow, conical, shaped-charge liner having a longitudinal axis;

fixedly interconnecting said sub-liners adjacent one pair of ends thereof to lock said one pair of ends against rotation relative to each other;

rotationally twisting said sub-liners in opposite directions about said longitudinal axis about said one pair of ends to provide each said sub-liner with a tangential shear stress of opposite sign and direction to that in the other said sub-liner;

fixedly interconnecting said sub-liners adjacent their other pair of ends to substantially preserve said opposite twisting to thereby provide said shaped-charge liner with residual tangential shear stress of opposite sign and direction in each said sub-liner.

2. The method of claim 1 in which said sub-liners are formed with substantially no residual tangential shear stress.

3. The method of claim 1 in which said sub-liners are formed with intrinsic spin compensation properties of opposite direction and in which said rotational twisting increases said intrinsic spin compensation properties in each said sub-liner.

4. The method of claim 1 in which each said sub-liner is rotationally twisted up to its tangential shear yield strength limit.

5. The method of claim 1 in which said sub-liners are fixedly interconnected adjacent one pair of ends thereof and in which:

said sub-liners are oppositely rotationally twisted to produce a substantially maximum allowable tangential shear stress in an annular volume increment of each said sub-liner adjacent said fixedly interconnected ends;

said sub-liners are further fixedly interconnected in the region of said annular volume increment to lock in said substantially maximum shear stresses of opposite sign and direction; and sequentially repeating the twisting and locking steps on adjacent volume increments progressively to said other pair of ends to substantially maximize the residual shear stress in said liner.

6. The method of claim 1 in which the outer and inner surfaces of the smaller and larger of said sub-liners, respectively, are roughened, said sub-liners being initially sized for slip-fit mating relation, said method further including varying the relative transverse sectional size of said sub-liners substantially concurrently with twisting said sub-liners to produce a locking fit between said roughened surfaces.

7. A spin compensating, shaped-charge liner comprising:

a pair of hollow, conical sub-liners sized to coaxially mate together to form said shaped-charge liner, said sub-liners being locked together at opposite ends thereof and being oppositely twisted therebetween to provide said shaped-charge liner with residual tangential shear stresses of opposite sign and direction in each said sub-liner.

8. The liner of claim 7 in which substantially all of the residual tangential shear stresses in each said sub-liner is due to said opposite twisting of said sub-liners.

9. The liner of claim 8 in which each said sub-liner has intrinsic spin compensation characteristics of opposite direction to those in the other said sub-liner which increase the spin compensation effect resulting from said residual tangential shear stresses in each said sub-liner.

* * * * *